US007163045B2

(12) United States Patent
Herreid et al.

(10) Patent No.: US 7,163,045 B2
(45) **Date of Patent: *Jan. 16, 2007**

(54) METHOD AND APPARATUS FOR MAKING A SAND CORE WITH AN IMPROVED PRODUCTION RATE

(75) Inventors: Richard M. Herreid, Austin, MN (US); Yuliy M. Yunovich, Austin, MN (US); Jeremy D. Eastman, Austin, MN (US)

(73) Assignee: Hormel Foods, LLC, Austin, MN (US)

( * ) Notice: Subject to any disclaimer, the term of this patent is extended or adjusted under 35 U.S.C. 154(b) by 452 days.

This patent is subject to a terminal disclaimer.

(21) Appl. No.: 10/643,568

(22) Filed: Aug. 19, 2003

(65) Prior Publication Data

US 2004/0031581 A1 Feb. 19, 2004

Related U.S. Application Data

(63) Continuation-in-part of application No. 10/101,439, filed on Mar. 18, 2002, now Pat. No. 6,666,253.

(51) Int. Cl.
*B22C 7/06* (2006.01)

(52) U.S. Cl. ..... 164/20; 164/12; 164/29; 164/369

(58) Field of Classification Search ..... 164/20, 164/12, 29, 369, 525, 529
See application file for complete search history.

(56) References Cited

U.S. PATENT DOCUMENTS

| | | | | |
|---|---|---|---|---|
| 2,145,317 | A | 1/1939 | Salzberg | 22/188 |
| 4,064,926 | A | 12/1977 | Naegele | 164/154 |
| 4,158,381 | A | 6/1979 | Michelson | 164/226 |
| 4,226,277 | A | 10/1980 | Matalon | |
| 4,867,228 | A | 9/1989 | Novelli et al. | 164/525 |
| 5,014,763 | A | 5/1991 | Frank | 164/15 |
| 5,262,100 | A | 11/1993 | Moore et al. | 264/25 |
| 5,320,157 | A | 6/1994 | Siak et al. | 164/12 |
| 5,365,995 | A | 11/1994 | Warner | 164/12 |

(Continued)

FOREIGN PATENT DOCUMENTS

| | | |
|---|---|---|
| EP | 221 537 | 5/1987 |

(Continued)

OTHER PUBLICATIONS

Wile, "Coremaking," ASM Handbook, Formerly Ninth Edition, Metals Handbook ASM International, vol. 15 Casting, The Materials Information Society, Materials Park, OH; pp. 238-241, 1988.

(Continued)

*Primary Examiner*—Len Tran
(74) *Attorney, Agent, or Firm*—IPLM Group, P.A.

(57) ABSTRACT

The present invention relates to A method and apparatus for making a sand core (112) utilizing purge air through a core box (100 and 100') to harden the binder in the sand core (112) proximate the ejection pins (106 and 106'). The sand core (112) may be removed from the core box (100 and 100') prior to drying the binder completely thereby resulting in an improved production rate of the sand core (112).

22 Claims, 3 Drawing Sheets

U.S. PATENT DOCUMENTS

| | | | | |
|---|---|---|---|---|
| 5,580,400 | A | 12/1996 | Takahashi | 148/302 |
| 5,580,624 | A | 12/1996 | Andersen et al. | 428/34.5 |
| 5,582,231 | A | 12/1996 | Siak et al. | 164/525 |
| 5,715,885 | A | 2/1998 | Nagarwalla et al. | 164/20 |
| 5,749,409 | A | 5/1998 | Siak et al. | 164/23 |
| 5,837,373 | A | 11/1998 | Siak et al. | 428/404 |
| RE36,001 | E | 12/1998 | Siak et al. | 164/525 |
| 6,016,862 | A | 1/2000 | Herreid | 164/525 |
| 6,090,915 | A | 7/2000 | Herreid | 530/350 |
| 6,467,525 | B1 | 10/2002 | Herreid et al. | 164/12 |
| 6,505,671 | B1 | 1/2003 | McKibben et al. | 164/12 |
| 6,666,253 | B1 | 12/2003 | Herreid et al. | |

FOREIGN PATENT DOCUMENTS

| | | |
|---|---|---|
| EP | 0 371 895 A2 | 6/1990 |
| EP | 0 608 926 A1 | 8/1994 |
| EP | 0 780 175 A1 | 6/1997 |
| WO | WO 98/17738 | 4/1998 |

OTHER PUBLICATIONS

Mold & Core Test Handbook; 3rd Edition; 2001.

Eastman, J., "Protein-Based Binder Update: Performance Put to the Test," *Modern Casting*, pp. 32-34 (Oct. 2000).

Ferrero, A. et al., "New Binder for Casting Cores: An Industrial Application to Safety Suspension Parts," *SAE Technical Paper Series, International Congress and Exposition, Detroit, Michigan*, Paper No. 981005 (pp. 1-6) (Feb. 23-26, 1998).

Mus, C. et al., "Innovative Foundry Technologies for Safety Aluminum Suspension Parts and Complex Castings," *SAE Technical Paper Series, SAE World Congress, Detroit, Michigan*, Paper No. 2001-01-0407 (8 pgs.) (Mar. 5-8, 2001).

FIG. 1
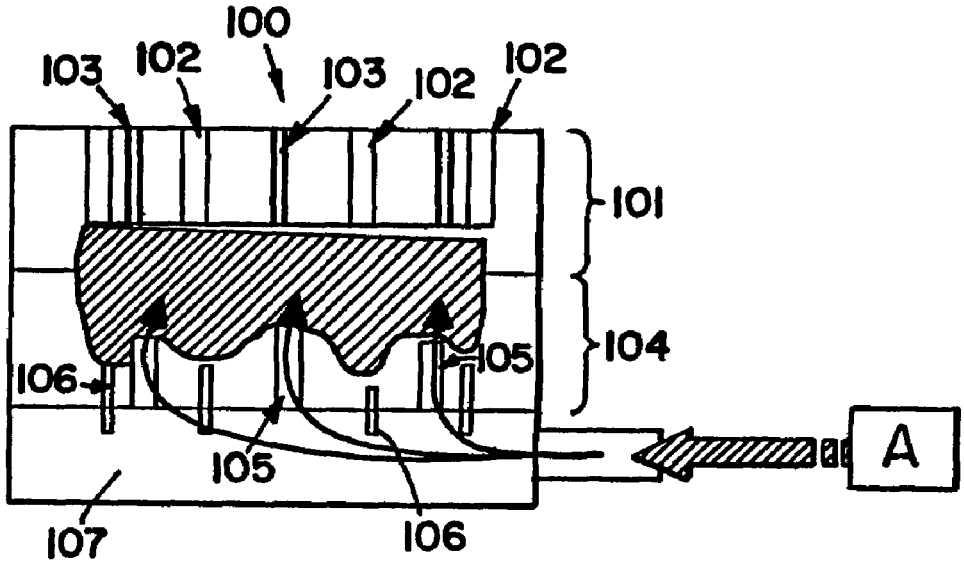
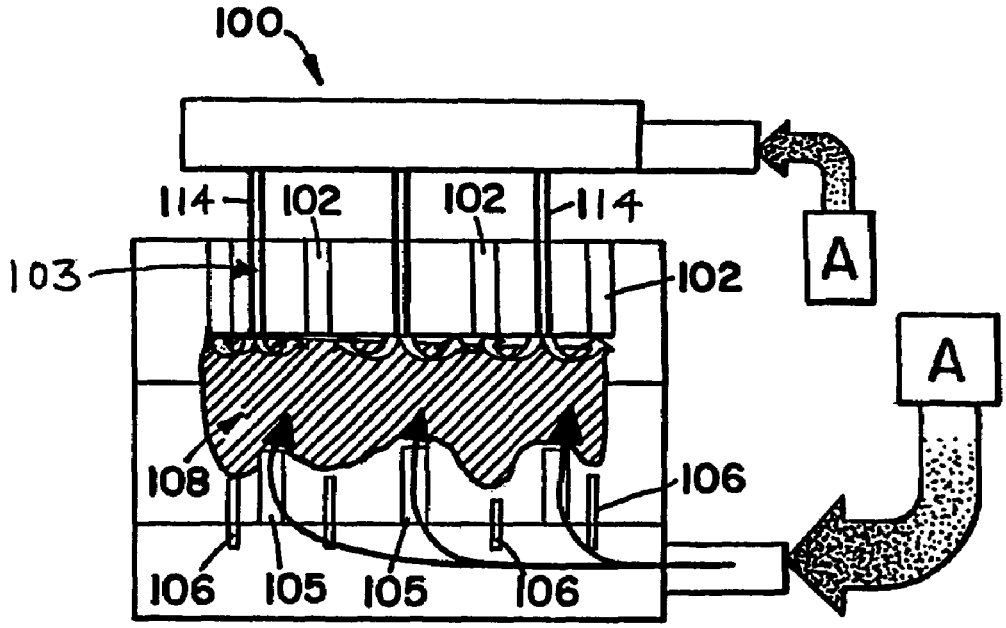
FIG. 2

FIG. 3
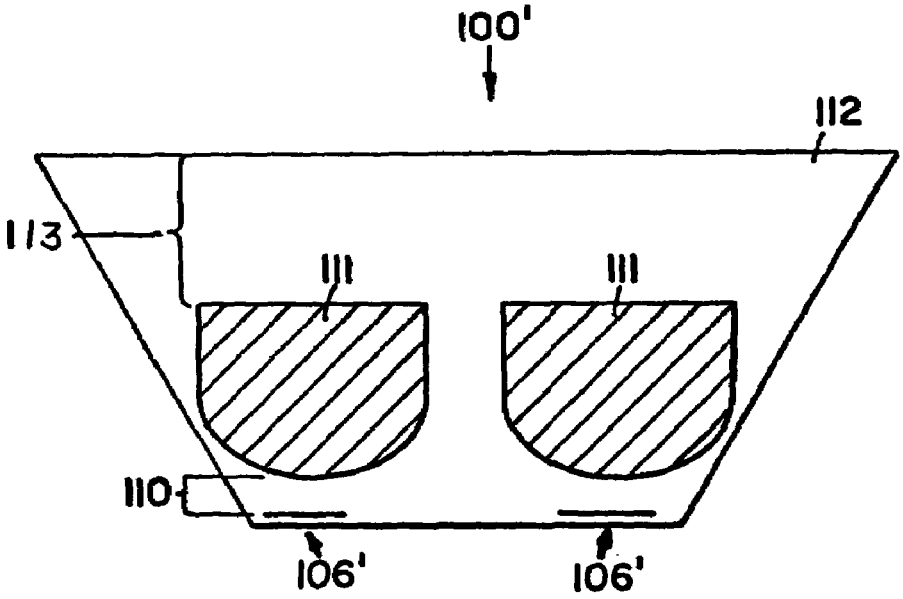
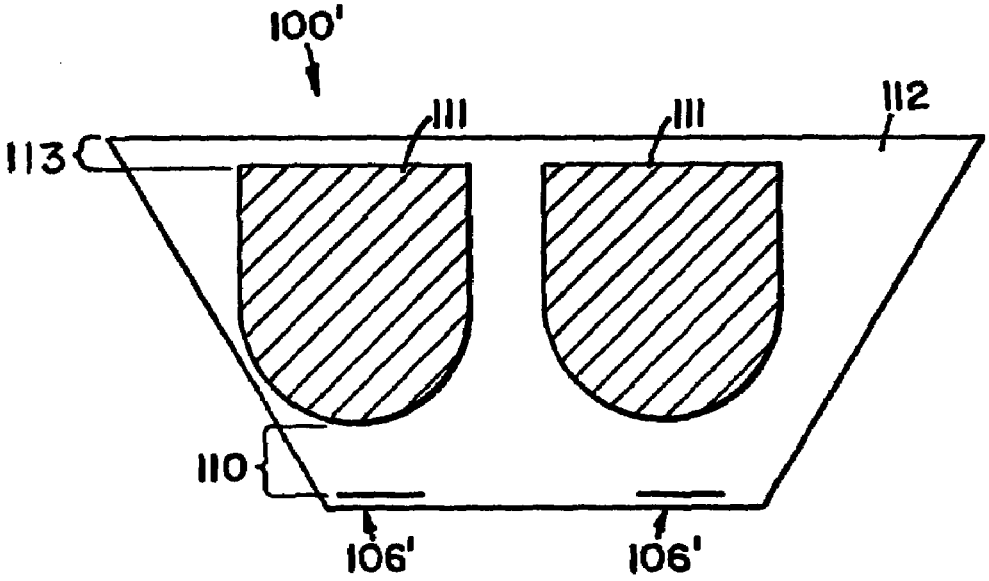
FIG. 4

METHOD AND APPARATUS FOR MAKING A SAND CORE WITH AN IMPROVED PRODUCTION RATE

This application is a continuation-in-part of U.S. application Ser. No. 10/101,439, filed Mar. 18, 2002, now U.S. Pat No. 6,666,253.

BACKGROUND OF THE INVENTION

1. Field of the Invention

The present invention relates to a method and apparatus for making a sand core with an improved production rate.

2. Description of the Prior Art

Cores and molds used in metal casting consist of a mass of refractory aggregate bound together to form a shape used as a pattern for molten metal during the casting process. The aggregate is typically coated with a binding material and then formed into a shape using a pattern. The binding material is typically hardened to hold the aggregate in the desired shape so the core or mold can be removed from the pattern. The core or mold is then used in giving shape to molten metal so that the metal takes the shape of the original pattern when the metal cools. In common usage, the mold forms the outer surface of the casting and the cores are used to form interior passages in the casting.

One of the most successful current methods for manufacturing cores uses a reactive chemical binder to coat a refractive aggregate such as silica sand. The binder coated sand is blown with air from a sand magazine into a core box having a cavity with a surface of the desired pattern to be used to form the core. The core box also includes vents, which are small openings extending through the core box into the cavity allowing air but not sand to pass through the cavity. Thus the air used to blow the sand into the pattern can escape the cavity while the sand is retained and fills the cavity pattern of the core box. The binder on adjacent sand grains must then be solidified at the contact points between sand grains to ensure that the sand holds the shape of the pattern once the sand core is removed from the core box. The solidification of the binder is often accomplished by passing reactive gas through the sand that reacts with the binder or catalyzes a hardening reaction. Typical examples are amine vapor used to harden phenolic urethane binders and sulfur dioxide gas used to harden acrylic/epoxy binders. Once the reaction has taken place, the reactive gas is usually purged from the core with air. Another type of binder is disclosed in U.S. Pat. No. 5,582,231 to Siak et al. where the hardening of the binder occurs by removal of moisture from the binder.

Typically the core box is divided into two sections which can be opened to remove the core after it has hardened to take the shape of the pattern in the internal cavity of the core box. The division of the core box can be along the horizontal axis where the upper part of the core box is called the cope and the lower part of the core box is called the drag. The division of the core box on the vertical axis results in a left part and a right part of the core box. It is usual for core boxes to have ejection pins along portions of the cavity surface to assist in removing the hardened cores from the core box when the core box parts are separated. These pins are metal rods, of which the ends are flush with the pattern surface of the core box cavity when the core box is closed and the sand is being blown into the box. When the box is opened the pins push against the surface of the core to remove it from the pattern. The pins can be spring-loaded, mechanically forced, or otherwise constructed by suitable means in the art to eject the core. Depending on the shape of the pattern, the ejection pins may be required to exert significant force on the surface of the core. In the drag the pins also support the weight of the core to lift it out of the core box so it can readily be removed from the core box.

The standard procedure for the introducing gas or air into the core box is to use a gassing manifold on the top of the box and an exhaust manifold on the bottom of the box. The gas and/or air passes from the top of the box where it is usually introduced through the blow holes through which the sand is blown into the core box or through vents in the upper surface of the core box. This is an efficient way to introduce reactive gas and purge air in core boxes using these binder systems. A noxious gas such as amine vapor and purge air containing traces of amines pass from the top of the core box, through the core contained within the cavity of the core box, and into the exhaust manifold where it can be collected and directed to a scrubber to remove the noxious gas from the air.

U.S. Pat. No. 5,582,231 to Siak et al. discloses the use of standard core blowing equipment and air to dry the sand core. Traditional core machines are those with purge air flow from the top of the core box to the bottom as described above and as shown in ASM Handbook® (Formerly Ninth Edition, Metals Handbook) Volume 15, "Casting" (1988). However, in the binding system which uses air to remove moisture from the binder to cause hardening (e.g. U.S. Pat. No. 5,582,231), this top to bottom air flow results in an inefficient core making process. The dry air introduced at the top of the core box will become saturated with moisture as it travels down through the hydrated sand in the core. Thus the lower part of the core will be the last part to be dried and hardened because the moisture is pushed downward. In practice this means that a large amount of the total moisture in the core must be removed before the bottom core surface is strong enough to support the force of the ejection pins without breaking and ruining the core when the core box is opened to remove the core. The rate at which cores can be made and removed from the core box, referred to as cycle time, is very important in determining the cost of a core making process. Long cycle times require more capital expense in more core boxes and core machines to produce a given number of cores in a given period of time.

SUMMARY OF THE INVENTION

In a preferred embodiment method of making a core in a core box, a binder coated aggregate which hardens with removal of moisture is blown into a cavity of a core box. The cavity is in fluid communication with an air source. Air is allowed to flow through the cavity and through the binder coated aggregate for a time less than required to completely dry the binder coated aggregate, wherein partially drying the binder coated aggregate creates a core with an inner portion and a hardened shell. The core is ejected from the core box before the core is completely dry. The binder within the inner portion of the core contains greater than 15% moisture, and the hardened shell remains substantially intact. An improved production rate of the core is achieved.

In a preferred embodiment method of making a core in a core box, a binder coated aggregate which hardens with removal of moisture is blown into a cavity of a core box, and the cavity is in fluid communication with an air source. Air is allowed to flow through the cavity and through the binder coated aggregate proximate ejection pins in the core box for a time less than required to completely dry the binder coated aggregate, wherein partially drying the binder coated aggregate creates a core with an inner portion and a hardened shell. The hardened shell proximate the ejection pins of the core box is approximately at least 0.50 inch thick and contains less than 15% moisture in the binder. The core is ejected from the core box before the core is completely dry, and the binder within the inner portion of the core contains greater than 15% moisture. The hardened shell remains substantially intact, and an improved production rate of the core is achieved.

In another preferred embodiment method of making a sand core in a core box, an air source is connected to a core box and gelatin coated sand is blown into a cavity of the core box. The cavity is in fluid communication with the air source. Air is allowed to flow into the cavity and through the gelatin coated sand for approximately 5 minutes or less, wherein partially drying the gelatin coated sand creates a core with a hardened shell proximate ejection pins of the core box. The hardened shell is approximately at least 0.50 inch thick. The sand core is ejected from the core box before the sand core is completely dry. The gelatin in the sand core contains at least 15% moisture, and the hardened shell remains substantially intact. An improved production rate of the sand core is achieved.

In another preferred embodiment method of making a sand core in a core box, the core box has a cope, a drag, and ejection pins. The cope and the drag define a cavity. The cope includes vent holes and blow holes, and the drag includes an exhaust manifold. The exhaust manifold, the vent holes, and the blow holes are in fluid communication with the cavity. An air source is connected to the exhaust manifold, and binder coated sand which hardens with removal of moisture is blown into the cavity via the blow holes. Air is allowed to flow through the exhaust manifold into the cavity for 5 minutes or less to contact the binder coated sand, wherein drying the binder coated aggregate creates a core with a hardened shell proximate the ejection pins. The hardened shell is approximately at least 0.50 inch thick. Air is exhausted through the vent holes. The core is ejected from the core box before the core is completely dry. The binder within an inner portion of the core contains greater than 15% moisture, and the hardened shell remains substantially intact. An improved production rate of the core is achieved.

BRIEF DESCRIPTION OF THE DRAWINGS

FIG. 1 is a schematic view of a core box with reverse air flow according to the principles of the present invention;

FIG. 2 is another schematic view of the core box shown in FIG. 1 with air flow from the top and the bottom of the core box according to the principles of the present invention;

FIG. 3 is a cross-section view of a partially dried core with air flow from only the top of the core box;

FIG. 4 is another cross-section view of the partially dried core shown in FIG. 3 with air flow from the bottom of the core box.

DETAILED DESCRIPTION OF THE PREFERRED EMBODIMENT

Figure 5:
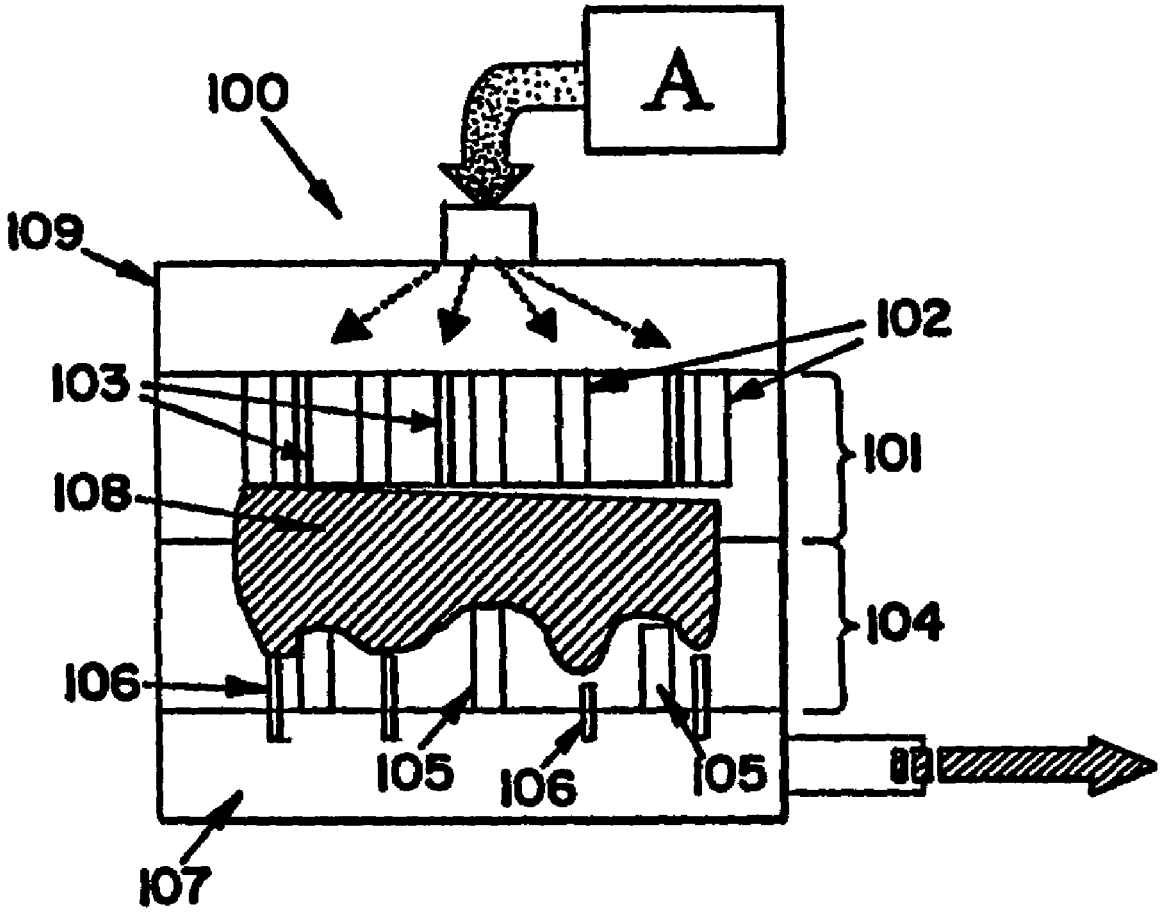
FIG. 5 is a schematic view of a core box with standard air flow for a typical commercial core machine.

The present invention relates to a method and apparatus for making a sand core with an improved production rate. A typical commercial core box is designated by numeral 100 in FIGS. 1, 2, and 5. FIG. 5 shows the standard air flow from the top to the bottom for the typical core box 100. FIG. 1 shows reverse air flow from the bottom to the top while FIG. 2 shows air flow from both the top and the bottom. Cross-section views of partially dried cores are shown in FIGS. 3 and 4 in a core box designated by the numeral 100'.

In the following description of the preferred embodiment, sand is the aggregate used to describe the invention but the invention can be used with any refractory aggregate such as ceramic or synthetic beads or other aggregates known in the art. In addition, the binder used to coat the aggregate is gelatin in the preferred embodiment, but other types of binders such as sodium silicate or other binders known in the art could also be used as long as the binder coated aggregate hardens with the removal of moisture from the binder to bind the aggregate particles together. Although the preferred embodiment utilizes gelatin coated sand particles, such as disclosed in U.S. Pat. No. 5,582,231 to Siak et al., which is incorporated by reference herein, other bonding agents well known in the art could be used with the present invention.

Because a mold box is essentially a larger core box, it is recognized that both sand molds and sand cores could be made using the present invention. The mechanism used to bind the sand into a shape is the same for molds and cores so the terms are used interchangeably throughout the specification, and it is understood that the use of either term does not limit the scope of the invention to one or the other. In particular, the present invention is useful for larger sand molds or sand cores that typically take longer to bind or dry. However, the present invention is equally useful for smaller sand molds or sand cores.

The preferred embodiment core boxes 100 shown in FIGS. 1, 2, and 5 includes a cope 101, which is the top portion, and a drag 104, which is the bottom portion. The core box 100 shown and described for the prior art and the preferred embodiment of the invention is horizontally divided, but it is understood that the invention also applies to core boxes that are vertically divided. The cope 101 and the drag 104 form a cavity 108, and the cavity 108 is where the binder coated aggregate is placed to form the core. The vents 102 in the cope 101 and the vents 105 in the drag 104 provide access to the cavity 108 and are small openings through which air but not sand can move. The cope 101 also includes blow holes 103 through which the binder coated aggregate is blown into the cavity 108 to form the core. The drag 104 also includes an exhaust manifold 107 in fluid communication with the vents 105. Typically, as sand is blown into the blow holes 103 with air, the air exits through the exhaust manifold 107. The cavity 108 is in fluid communication with the vents 102 and 105, the blow holes 103, and the exhaust manifold 107.

The cope 101 has vents 102 and blow holes 103 through which air or gas is typically circulated into the core box 100 from air or gas source A through the gassing manifold 109 which is in fluid communication with the cope vents 102. A vacuum source (not shown) is typically connected to the exhaust manifold 107 to draw out the air or gas that has entered the cavity 108 from the vents 102 and dispose of the air or gas. The drag 104 has vents 105 through which air or gas is normally circulated out of the core box 100 through the exhaust manifold 107. This is shown in FIG. 5.

In the present invention, as shown in FIGS. 1 and 2, the vacuum source has been disconnected and an air source A has been connected to the exhaust manifold 107. After the sand has been blown into the cavity 108, the air source A may be connected and air allowed to flow through the exhaust manifold 107 thereby drying the sand from the bottom. In FIGS. 1 and 2, ejection pins 106 are located along the drag 104 to eject the core from the core box 100. Ejection pins 114, shown in FIG. 2, are located along the cope 101 to eject the core from the core box 100. Typically, ejection pins are steel rods, but the ejection pins of the preferred embodiment have been modified. The modified ejection pins 106 are hollow tubes with vents on the ends of the pins against the surface of the cavity 108. The term "vents" is used generically to describe vents in the core box itself and vents in the hollow ejection pins. The vents in either instance could be screen baffles that prevent sand but allow air to flow through the vents, and it is recognized that any type of vent known in the art could be used. The drag ejection pins 106 may be of any length and placed along the drag 104 in numerous locations to accommodate various sizes and shapes of molds. The cope ejection pins 114 may also be of any length and placed along the cope 101 in numerous locations to accommodate various sizes and shapes of molds. The cope ejection pins 114 are shown aligned with the blow holes 103 in FIG. 2, but it is understood that the cope ejection pins 114 may be independent of the blow holes 103 similar to the drag ejection pins 106.

FIG. 1 shows the air source A blowing air into the core box 100 from the drag 104, and FIG. 2 shows the air source A blowing air into the core box 100 from the cope ejection pins 114 and the drag 104. Air may be blown into the core box 100 through both the ejection pins in the cope 114 and the drag 106 as well as through the vents 105 in the drag 104 and the air is exhausted through the vents 102 in the cope 101. If air cannot escape through the vents 102 in the cope 101, then air cannot escape the core box 100 and the core will not dry properly. Air could also be exhausted through the blow holes 103 and the hollow ejection pins, if present, in the cope 101. An example of a core box that could be used produces a generally rectangular, 12 pound core for the interior of an electric box. The core box was manufactured by Winona Pattern and is operated with a Redford HCB22 core machine, but it is recognized that other suitable core-making equipment known in the art could be used. Another example is a core box with cavities for making two cylinder head valve train sand cores weighing approximately 15 kg each was mounted on a FATA Peterle core machine designed for a standard phenolic urethane cold box core process. Cross-section views of the valve train core are shown in FIGS. 3 and 4. Although the descriptions and the examples included herein utilize specified sizes and/or shapes of sand core boxes, it is recognized that many different sizes and/or shapes of sand core boxes could be utilized without departing from the scope of the invention.

The core cross-section in the core box 100' shown in FIG. 3 shows a partially dried gelatin coated sand core 112 that has been dried with air entering the core box 100' from the cope 101. FIG. 3 shows the prior art that would be made with core box shown in FIG. 5. When air is blown into the core box 100' through the cope 101 only, a thicker top portion or shell 113 of the sand 112 is formed. This is because as the air enters the core box 100' from the cope 101, the water or moisture is pushed downward by the air thereby drying the top portion 113 faster than the bottom portion 110 of the sand 112. However, because the core box 100' is often heated, a thin shell of dried binder coated sand is formed proximate the core box cavity surface even though the air is bringing the moisture through the sand toward the bottom portion 110 of the core 112. However, the wet portions 111 of the sand are located relatively closer to the bottom portion 110 of the core proximate the ejection pins 106'. In ejecting the core, the thin shell 110 over the ejection pins can break thereby ruining the core, unless a longer drying time is used to thicken the shell 110. Therefore, the shell 113 located proximate the cope 101 is thicker than the shell 110 located proximate the drag 104.

The core 100' shown in FIG. 4 shows a cross-section of a partially dried sand core that has been dried with air entering the core box 100' from the drag 104. When air is blown into the core box 100' through the drag 104, a thicker bottom portion or shell 110 of the sand is formed. As the air enters the core box 100' from the drag 104, the water or moisture is pushed upward by the air thereby drying the bottom portion 110 faster than the top portion 113 of the sand. Therefore, the wet portions 111 of the sand are located relatively closer to the cope 101 than to the drag 104. However, because the core box 100' is often heated, a thin shell of dried binder coated sand is formed proximate the top portion 113 even though the air is bringing the moisture through the sand toward the top portion 113 of the core. Therefore, the shell 110 located proximate the drag 104 is thicker than the shell located proximate the cope 101. Because the bottom portion 110 is relatively thick, the ejection pins 106' of the core box 100' can eject the core before the core is completely dried without breaking the shell 110. In other words, when the bottom portion 110 is relatively thick, the core can be ejected and the shell 110 remains substantially intact even though the core is not completely dried. To be substantially intact, the shell 110 must not be broken or contain cracks or voids large enough to compromise the structural integrity of the core. The core can then be completely dried outside the core box 100'.

One goal of the present invention is to make quality sand cores and reduce the time needed within the core box before the cores are removed without ruining the core. This process allows removal of the cores from the core box sooner than the conventional process because the amount of moisture that must be removed in the core box is minimized. U.S. Pat. No. 5,582,231 to Siak et al. discloses drying the sand core so as to dehydrate the coalesced gel to a total water content level no greater than about 15% by weight thereby hardening the core sufficiently that it is strong enough for handling and casting of metals. The present invention allows the sand core to be removed before it is completely dry, i.e. before the total water content level in the binder has been reduced to about 15% or less. The core box tooling and core machine are very expensive, and this process increases the number of cores that can be made in each core box and core machine, regardless of the size and/or shape of the core.

One way this can be accomplished is to reverse the normal flow of the purge air through the core box 100 as shown in FIG. 1. Reversing the normal flow of purge air by putting the purge/drying air through the exhaust vents 105 rather than through the vents 102 provides maximum core strength over the ejection pins 106. The purge air connection is removed from the gassing head 109 in the cope 101, as shown in FIG. 5, and connected to the core box exhaust manifold 107 in the drag 104, as shown in FIG. 1. With reversed purge air flow coming into the cavity 108 from the drag 104 of the core box 100, a thicker hard section or shell is formed over the ejection pins 106. This thicker shell prevents breakage of the core by the ejection pins 106 and allows removal of the core from the core box 100 while it still contains a significant amount of water. This speeds up the core making process because the core drying can be completed outside the core box 100 in an independent, outside heating source such as an oven or other drying instrument well known in the art. FIG. 4 shows the cross-section view of a core made with the process of this invention.

Another way this could be accomplished is to use drying air input from both the cope 101 and the drag 104 of the core box 100 to build stronger areas over both the upper ejection pins 114 and the lower ejection pins 106, if upper ejection pins are present. This is illustrated in FIG. 2. In some core boxes, ejection pins are located at both the top and the bottom of the core box. In this instance, drying air can be introduced through the bottom vents 105 of the core box 100 as well as through hollow upper ejection pins 114 and hollow lower ejection pins 106. By adjusting the upper and lower air pressures and flows correctly, thicker shells form over both the upper and the lower ejection pins to maximize the core strength thereby increasing the production rate of the core.

It is recognized that the drying air input may be from the cope, from the drag, and/or from the sides of the core box using the present invention as long as the shell(s) formed proximate the ejection pins is/are strong enough so that the shell(s) remain substantially intact upon ejection of the partially dried core.

EXAMPLE 1

A core box with cavities for making two cylinder head valve train sand cores weighing 15 kg each was mounted on a FATA Peterle core machine designed for a standard phenolic urethane cold box core process. The air supplying the purge air manifold was dried and heated to facilitate moisture evaporation. The core box was heated with electrical heating elements. The core box was of the type horizontally divided with an upper section (cope) and lower section (drag). Both the cope and drag had slot vents that allowed air but not sand to pass through. The drag vents were open to an exhaust manifold that collected the air and/or gas exiting the drag and directed it to a scrubbing system. Instruments to measure air flow and moisture in the air were placed in the exhaust manifold outlet to measure the amount of moisture removed from the core during the drying/hardening process. The cope vents were on the top surface of the cope and were covered by the purge air manifold when the manifold was clamped in position on top of the core box. The cope and drag both had ejection pins, which pushed the core out of the cope and drag cavities as the core box opened. After the core box opened, the cores remained suspended on the drag ejection pins until they were removed from the core box. The cope section of the core box also contained blow holes through which sand was blown into the closed core box. The blow holes were in the top of the cope and were covered by the purge air manifold when it was in place on top of the core box. This core box set up is similar to that shown in FIG. 5.

Cores were made by blowing sand coated with a 1% gelatin binder and rehydrated with 2% water (both percentages based on the weight of sand) into the core box heated at about 140° C. using about 60 pounds per square inch (psi) air pressure. The sand magazine was moved away from the core box and the purge air manifold was clamped onto the top of the core box. After about a 90 second binder activation period, hot air at about 30 psi and 250° C. was directed through the purge air manifold, into the core box cope, through the core cavity, and discharged through the exhaust manifold for purge times specified in Table 1. The hot purge air was used to dry the binder causing it to harden and solidify the sand in the shape determined by the core box cavity. The conditions used to make cores and the results are in Table 1.

This example shows the results of using a standard core machine purge air process with air movement from the top of the core to the bottom of the core, which is hardened by removing moisture from the core binder, as is done in the prior art. Air purge times of greater than 3 minutes with total cycle times of about 5 minutes was required to form core with bottom surface strong enough to withstand drag ejection pin pressure.

TABLE 1

Top (Prior Art) Purge Air Process

| Test # | Purge Time (minutes) | Total Cycle Time (minutes) | % Moisture Removed | Core Quality |
|---|---|---|---|---|
| 1 | 3.0 | 4.0 | — | Core stuck in core box |
| 2 | 3.3 | 4.8 | 85% | Good cores |
| 3 | 3.3 | 5.8 | 78% | Good cores |
| 4 | 3.3 | 5.8 | 80% | Good cores |
| 5 | 2.5 | 4.7 | 63% | Broken lower surface - drag ejection pins penetrated core |

Samples of the cores were cut over the main drag ejection pin locations to expose the cross section at this location. The remaining loose, wet sand was removed to determine the amount of hardened sand shell over the ejection pins. The cores that were removed from the core box undamaged had a hardened sand shell approximately at least 0.50 inch thick. Cores such as from Test 5 in Table 1 where the ejection pins penetrated the core surface ruining the core had hardened shells of about 0.25 inch.

EXAMPLE 2

The same core box used in Example 1 was used, but the core box was set up with the purge air supply connected to the exhaust manifold, which supplied air to the drag vent openings of the bottom of the core box. The purge air left the core box through the cope vents on the top of the core box. This core box set up is shown in FIG. 1. The instruments used to measure air flow and air moisture content were not used as there was no common air manifold for the air leaving the core box. The cope ejection pins were used to partially block the blow holes in the top of the cope to minimize the amount of sand blown out of the blow holes during the air purge process.

Blowing the cylinder head valve train core as described in Example 1 until the modified purge air flow as described above gave the results shown in Table 2. Air purge pressure was about 15 psi and the activation time between core blowing and start of purge ranged from 1.5 to 2 minutes. "Shell Thickness" in Table 2 refers to the thickness of the hardened shell over the main drag ejection pins (on the bottom) and under the cope ejection pins (on the top) immediately after removal from the core box.

TABLE 2

Bottom Purge Air Process

| Test # | Activation Time (minutes) | Purge Time (minutes) | Total Cycle Time (minutes) | Shell Thickness (inch) Bottom | Shell Thickness (inch) Top | Core Quality |
|---|---|---|---|---|---|---|
| 6 | 1.0 | 2.0 | 3.0 | 0.75 | 0.25 | Good cores |
| 7 | 1.5 | 1.5 | 3.0 | 0.50 | 0.25 | Good cores |

After modifying the ejection pins to completely block the blow holes in the cope, allowing more air pressure to be used, additional tests were run with purge air pressures ranging from about 15 psi to about 60 psi. The other conditions were the same as those used in tests reported in Table 2. The results of these additional tests are given in Table 3.

TABLE 3

Top and Bottom Purge Air Process

| Test # | Activation Time (minutes) | Purge Time (minutes) | Total Cycle Time (minutes) | Purge Air Pressure (psi) | Core Quality |
|---|---|---|---|---|---|
| 8 | 0.50 | 1.67 | 2.17 | 60 | Good cores |
| 9 | 0.42 | 1.33 | 1.75 | 60 | Good cores |

EXAMPLE 3

Tests were conducted to measure the hard, outer shells of partially dried sand cores produced with the drying air flow direction from either top to bottom or bottom to top. The sand cores were made with 520 silica sand coated with 1% gelatin binder. The amounts of sand, the thickness, and the moisture levels of the hard, outer shells on the top and on the bottom of the sand cores, as well as the soft inner portion of the sand cores, were measured. Data was collected for 1, 2, and 5 minutes of air drying in the core box. The air flow of the hot, drying air was either top to bottom (cope to drag) or bottom to top (drag to cope) in the core box. The core box used was for an interior core of an electric box. The core had a total weight of 12 pounds and the body was approximately 5 inches square and approximately 8 inches long excluding the neck of the core. The core was blown on the horizontal Redford CB22 core machine. Once the core was removed from the core machine, it was cut in half with a saw and the soft, moist sand in the inner portion was removed to leave the hard, outer shell. Sand from the inner portion and the upper and lower shells was analyzed for moisture content.

The results are shown in Tables 4, 5, and 6. The number of the test shown in Table 4 corresponds with the same number of the test shown in Tables 5 and 6. Table 4 shows the moisture level and the shell thickness in the top shell of the core, Table 5 shows the moisture level and the shell thickness in the bottom shell of the core, and Table 6 shows the moisture level in the inner portion of the core. For example, in Test 1, air was blown from top to bottom for 1 minute. The top shell of the core was 0.75 inch thick, the bottom shell of the core was 0.33 inch thick, and the amount of moisture in the soft, inner portion of the core was 1.97%.

The moisture level is expressed in two different ways, the moisture level in the sand core and the moisture level in the binder. The moisture level in the binder was calculated by dividing the moisture level by the sum of the moisture level and the binder level.

TABLE 4

Moisture Level and Shell Thickness in Top Shell of Core

| Test | Time (minutes) | Air Direction | Thickness (inches) | Moisture in Sand (%) | Moisture in Binder (%) |
|---|---|---|---|---|---|
| 1 | 1 | top to bottom | 0.75 | 0.07 | 6.50 |
| 2 | 1 | bottom to top | 0.27 | 0.05 | 4.80 |

TABLE 4-continued

Moisture Level and Shell Thickness in Top Shell of Core

| Test | Time (minutes) | Air Direction | Thickness (inches) | Moisture in Sand (%) | Moisture in Binder (%) |
|---|---|---|---|---|---|
| 3 | 2 | top to bottom | 0.96 | 0.09 | 8.30 |
| 4 | 2 | bottom to top | 0.25 | 0.04 | 3.80 |
| 5 | 5 | top to bottom | 1.68 | 0.05 | 4.80 |
| 6 | 5 | bottom to top | 0.27 | 0.05 | 4.80 |

TABLE 5

Moisture Level and Shell Thickness in Bottom Shell of Core

| Test | Time (minutes) | Air Direction | Thickness (inches) | Moisture in Sand (%) | Moisture in Binder (%) |
|---|---|---|---|---|---|
| 1 | 1 | top to bottom | 0.33 | 0.08 | 7.40 |
| 2 | 1 | bottom to top | 0.62 | 0.05 | 4.80 |
| 3 | 2 | top to bottom | 0.36 | 0.08 | 7.40 |
| 4 | 2 | bottom to top | 1.03 | 0.04 | 3.80 |
| 5 | 5 | top to bottom | 0.57 | 0.05 | 4.80 |
| 6 | 5 | bottom to top | 2.30 | 0.04 | 3.80 |

TABLE 6

Moisture Level in Inner Portion of Core

| Test | Time (minutes) | Air Direction | Moisture in Sand (%) | Moisture in Binder (%) | % Total Sand in Center |
|---|---|---|---|---|---|
| 1 | 1 | top to bottom | 1.97 | 66.30 | 63.20 |
| 2 | 1 | bottom to top | 2.12 | 67.90 | 67.50 |
| 3 | 2 | top to bottom | 2.10 | 67.70 | 57.30 |
| 4 | 2 | bottom to top | 2.13 | 68.10 | 55.40 |
| 5 | 5 | top to bottom | 1.82 | 64.50 | 31.30 |
| 6 | 5 | bottom to top | 1.76 | 63.80 | 29.10 |

The results show that the gelatin binder in the dried shell portions of the core contains less than approximately 10% moisture while the soft, inner portion of the core contains approximately 60 to 70% moisture in the gelatin binder. The one minute drying air cycle produced dry shells greater than approximately 0.60 inch thick at the air inlet and approximately 0.30 inch thick at the air outlet, depending upon the direction of air flow. With the one minute drying time, approximately 35% of the total initial amount of moisture in the sand core was removed prior to removal from the core box. Once the core was removed from the core box, it was further dried in an oven, which was much more economical than completely drying the core in the core machine.

EXAMPLE 4

In the core box from Example 1, the purge air flow was directed into the exhaust manifold air opening proximate the bottom of the core box and out the top of the core box. The cope heat and the drag heat in the core box were set at 140° C., and the purge air temperature was 250° C. It took approximately 1.25 minutes from the initial blowing of the core to begin purging the core box with the air. The purge air through the exhaust manifold, with the cope pins down, was performed for approximately 2 minutes at approximately 1 bar. No sand was blown out through the cope. This reverse air flow created a thicker shell proximate the drag ejection pins so that the sand cores could be removed sooner from the core box. The top shell of the sand core was approximately 0.375 inch and the bottom shell of the sand core was approximately 0.625 to 0.75 inch. The initial weight of the sand core was 14,564 grams, and the final weight of the sand core was 14,442 grams. The initial sand moisture was 1.93%, and the initial amount of water in the sand was 284 grams. The water remaining in the sand core was 122 grams, or 43% of the initial amount of water.

EXAMPLE 5

In the core box from Example 1, the purge air flow was directed into the exhaust manifold air opening proximate the bottom of the core box and out the top of the core box. The cope heat and the drag heat in the core box were set at 140° C., and the purge air temperature was 250° C. It took approximately 1.25 minutes from the initial blowing of the core to begin purging the core box with the air. The purge air through the exhaust manifold, with the cope pins down, was performed for approximately 2 minutes at approximately 1 bar. The purge air was then continued at approximately 2 bar for approximately 30 seconds. No sand was blown out through the cope. This reverse air flow created a thicker shell proximate the drag ejection pins so that the sand cores could be removed sooner from the core box. The top shell of the sand core was approximately 0.375 inch and the bottom shell of the sand core was approximately 1.25 to 1.50 inches. The initial weight of the sand core was 14,514 grams, and the final weight of the sand core was 14,444 grams. The initial sand moisture was 1.93%, and the initial amount of water in the sand was 284 grams. The water remaining in the sand core was 70 grams, or 25% of the initial amount of water.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method of making a core in a core box, comprising:

a) blowing a binder coated aggregate which hardens with removal of moisture into a cavity of a core box, the cavity being in fluid communication with an air source;

b) allowing air to flow through the cavity and through the binder coated aggregate for a time less than required to completely dry the binder coated aggregate, wherein partially drying the binder coated aggregate creates a core with an inner portion and a hardened shell; and c) ejecting the core from the core box before the core is completely dry, the binder within the inner portion of the core containing greater than 15% moisture, the hardened shell remaining substantially intact, wherein an improved production rate of the core is achieved.

2. The method of claim 1, wherein air flows into the cavity from a bottom portion of the core box.

3. The method of claim 2, the bottom portion of the core box being an exhaust manifold.

4. The method of claim 2, the bottom portion of the core box being an exhaust manifold and hollow ejection pins.

5. The method of claim 1, wherein air flows into the cavity from a top portion of the core box.

6. The method of claim 1, wherein air flows into the cavity concurrently from a top portion and from a bottom portion of the core box.

7. The method of claim 1, the hardened shell being approximately at least 0.50 inch thick proximate ejection pins of the core box.

8. The method of claim 1, the aggregate being sand.

9. The method of claim 1, the binder being gelatin.

10. A method of making a core in a core box, comprising:

a) blowing a binder coated aggregate which hardens with removal of moisture into a cavity of a core box, the cavity being in fluid communication with an air source;

b) allowing air to flow through the cavity and through the binder coated aggregate proximate ejection pins in the core box for a time less than required to completely dry the binder coated aggregate, wherein partially drying the binder coated aggregate creates a core with an inner portion and a hardened shell, the hardened shell proximate the ejection pins of the core box being approximately at least 0.50 inch thick and containing less than 15% moisture in the binder; and c) ejecting the core from the core box before the core is completely dry, the binder within the inner portion of the core containing greater than 15% moisture, the hardened shell remaining substantially intact, wherein an improved production rate of the core is achieved.

11. The method of claim 10, wherein air flows into the cavity from a bottom portion of the core box.

12. The method of claim 10, wherein air flows into the cavity from a top portion of the core box.

13. The method of claim 10, wherein air flows into the cavity concurrently from a top portion and from a bottom portion of the core box.

14. The method of claim 10, the aggregate being sand.

15. The method of claim 10, the binder being gelatin.

16. A method of making a sand core in a core box, comprising:

a) connecting an air source to a core box;

b) blowing gelatin coated sand into a cavity of the core box, the cavity being in fluid communication with the air source;

c) allowing air to flow into the cavity and through the gelatin coated sand for approximately 5 minutes or less, wherein partially drying the gelatin coated sand creates a core with a hardened shell proximate ejection pins of the core box, the hardened shell being approximately at least 0.50 inch thick; and d) ejecting the sand core from the core box before the sand core is completely dry, the gelatin in the sand core containing at least 15% moisture, the hardened shell remaining substantially intact, wherein an improved production rate of the sand core is achieved.

17. The method of claim 16, wherein air flows through the gelatin coated sand for approximately 2 minutes or less at approximately 1 bar.

18. The method of claim 17, further comprising allowing air to flow into the cavity and through the gelatin coated sand for an additional 30 seconds at approximately 2 bar.

19. A method of making a sand core in a core box, the core box having a cope, a drag, and ejection pins, the cope and the drag defining a cavity, the cope including vent holes and blow holes, the drag including an exhaust manifold, the exhaust manifold, the vent holes, and the blow holes being in fluid communication with the cavity, comprising:

a) connecting an air source to the exhaust manifold;

b) blowing binder coated sand which hardens with removal of moisture into the cavity via the blow holes;

c) allowing air to flow through the exhaust manifold into the cavity for 5 minutes or less to contact the binder coated sand, wherein drying the binder coated aggregate creates a core with a hardened shell proximate the ejection pins, the hardened shell being approximately at least 0.50 inch thick d) exhausting air through the vent holes; and e) ejecting the core from the core box before the core is completely dry, the binder within an inner portion of the core containing greater than 15% moisture, the hardened shell remaining substantially intact, wherein an improved production rate of the core is achieved.

20. The method of claim 19, further comprising allowing air to flow through the ejection pins, the ejection pins being hollow and in fluid communication with the exhaust manifold and the cavity.

21. The method of claim 19, further comprising connecting the air source to a top portion of the core box, the cavity being in fluid communication with the top portion of the core box, and concurrently allowing air to flow through the exhaust manifold and the top portion of the core box, wherein air from the air source flows through the exhaust manifold and the top portion into the cavity and through the binder coated sand.

22. The method of claim 19, the binder being gelatin.

* * * * *